US005873571A

United States Patent [19]

Vaisman et al.

[11] Patent Number: 5,873,571

[45] Date of Patent: Feb. 23, 1999

[54] METHOD OF PLAYING THE CARD GAME FIMAROLLA

[76] Inventors: Efim Vaisman; Olga Vaisman; Margarita Vaisman, all of 3203 Nostrand Ave., Apt. 2-T, Brooklyn, N.Y. 11229

[21] Appl. No.: 797,716

[22] Filed: Feb. 11, 1997

[51] Int. Cl.[6] ..... A63F 1/00

[52] U.S. Cl. ..... 273/292; 273/274

[58] Field of Search ..... 273/292, 274

[56] References Cited

U.S. PATENT DOCUMENTS 5,265,882 11/1993 Malek ..... 273/274

5,288,077 2/1994 Jones ..... 273/292

5,322,295 6/1994 Cabot et al. ..... 273/274

5,395,120 3/1995 Malek ..... 273/292

5,486,005 1/1996 Neal ..... 273/274

*Primary Examiner*—William M. Pierce

*Attorney, Agent, or Firm*—Thomas A. Beck; Baker & Friedman

[57] ABSTRACT

A casino card game played by up to eight players using eight, ten or twelve standard decks of playing cards. The game comprises three sequential games of blackjack followed by a game of five card poker wherein the players, competing against a dealer, must wager on the black jack and poker games before the cads are dealt.

3 Claims, 1 Drawing Sheet

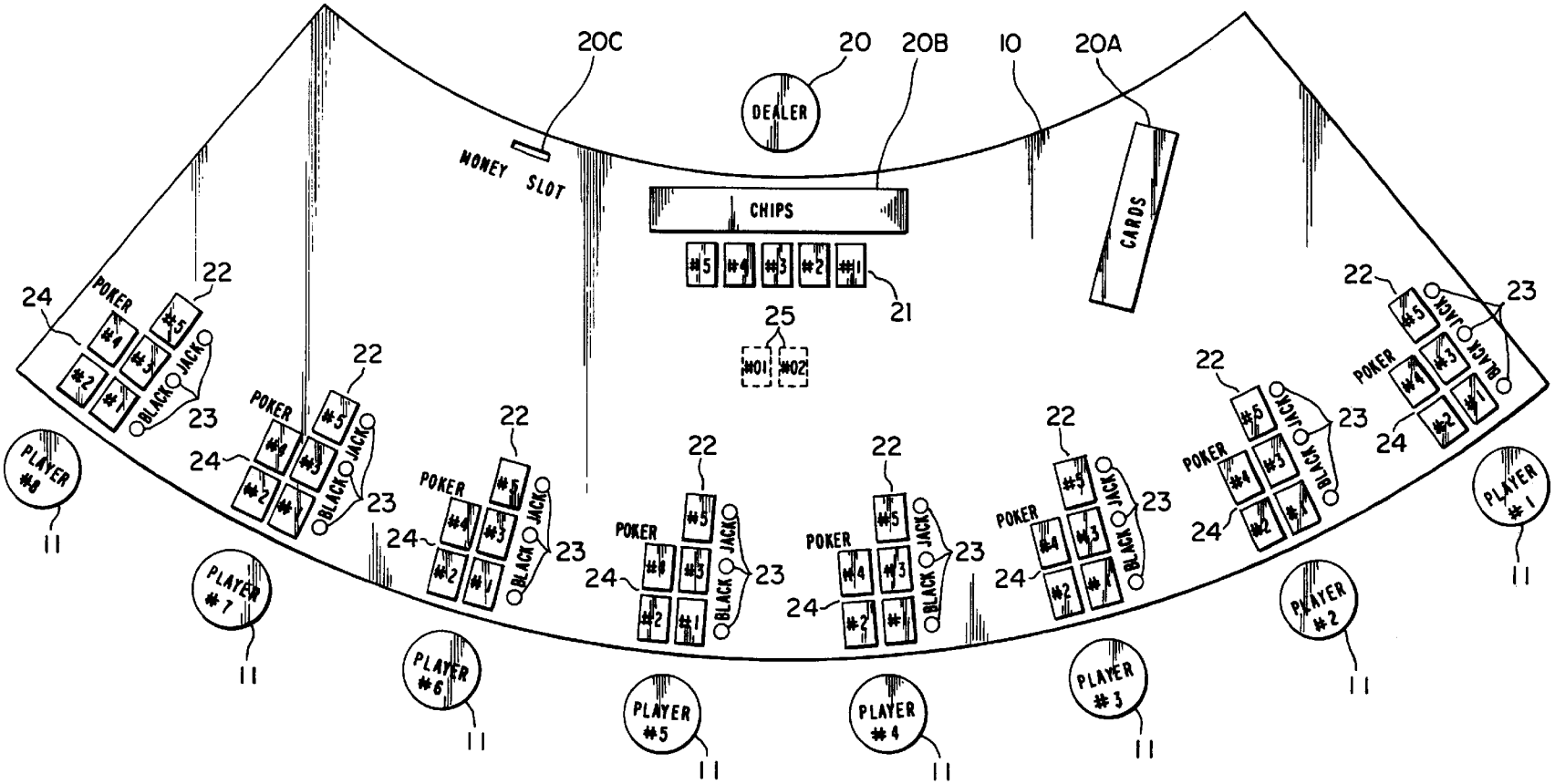
FIG.

METHOD OF PLAYING THE CARD GAME FIMAROLLA

BACKGROUND OF THE INVENTION

1. Field of the Invention

The present invention relates to a casino card game bearing similarities to two existing casino card games, and more particularly to a game known as "Fimarolla" which combines certain features of the card games known as Poker and Blackjack.

2. Description of the Prior Art

The public perception of the card games played by the public against the house is that the player's statistical probability of continued success is limited. Because of the nature of the games played in casinos, such as Blackjack, Gin Rummy or Poker, the initial cards dealt to the player, especially a novice, can quickly eliminate any possibility of beating the house thus lessening the inclination of the player to continue playing. Certain card games have been developed which are more "player friendly" thereby enabling the player to have a plurality of chances to win.

U.S. Pat. No. 5,072,946 discloses a card game played with one or two decks of cards involving two hands in which no player strategy affects the outcome of the game. The player selects which of the hands he thinks will win the game or whether the game will end in a tie. The game utilizes the numerical value of the cards as determinative of the outcome.

U.S. Pat. No. 5,275,415 discloses a card game played with fifty-two cards and four jokers that is not Blackjack but requires counting of card values to reach a predetermined unique point total, for example, a point total count of twenty-two points or as close to it as possible. Contrary to many casino card games, each of the players in turn is designated the dealer. The game rules are similar to Blackjack.

U.S. Pat. No. 5,486,005 discloses a method and apparatus for playing a poker-like game in which the player competes against the dealer. Each player can select his hand or a position after seeing a predetermined number of cards dealt to each hand.

U.S. Pat. No. 5,549,300 discloses a card game similar in form to the game of Twenty-One, but in which different play options are provided by modifying the deck of cards used. The object is to get closest to a numerical hand count of twenty. If the numerical count exceeds twenty, then the numerical count of the cards reverts by subtracting ten therefrom. Thus the player never encounters a "bust" hand situation.

It is an object of the present invention to provide a card game based upon a combination of the rules of Poker and Black Jack. The game of the present invention, "Fimarolla," combines many of the rules of the aforementioned card games into a single game and is ideally suited as a casino game.

Other objects, features and advantages of the present invention will become apparent from a consideration of the following detailed invention.

SUMMARY OF THE INVENTION

The game of the present invention is practiced using eight, ten or twelve decks of playing cards of fifty-two cards each. There are up to eight players who participate in the game. The game comprises three sequential games of Black Jack followed by a game of poker and the player must wager on the Black Jack games and the Poker game before any cards are dealt. The method of playing the present invention is practiced on a gaming table having convenient squares situated thereon before each player's place upon which the cards and the bets are placed for each of the games.

More particularly the method of the present invention relates to playing a game among a dealer and at least one player person, utilizing at least eight standard decks of playing cards, each said deck having four different suits, (clubs, diamonds, hearts and spades) each suit having cards with a face side displaying a number from two to ten respectively, picture cards, i.e. jacks, queens and kings, and aces. Each player makes a plurality of wagers for the four games to be played prior to the playing of the games.

The individual games are played sequentially. First card nos.1 and 2 are dealt sequentially to the player and dealer. First card nos.1 and card no.2 are dealt face up to a player. These two cards comprise the player's first game hand. The dealer is dealt card no.1 face up and card no.2 face down and comprise the dealer's first hand.

At a location remote from said player and said dealer, in the center of the table on which the game is played, a first card 01 is dealt face down;

if the player's first game hand has a numerical total of twenty-one and said dealer's hand has a numerical total of twenty-one, the dealer's hand is the winning hand of said first game;

if the player's first game hand has a numerical total less than twenty-one, the player stands or draws additional cards as the player desires provided the numerical total does not exceed twenty-one, and thereafter said dealer's hand has a numerical total of twenty-one, the dealer's hand is the winning hand of said first game;

if the player's first game hand does not exceed twenty-one and does exceed the numerical value of the dealer's hand, the player's hand is the winning hand of said first game; if the player's first game hand has a numerical total less than twenty-one, the player draws additional cards as the player desires and the numerical total exceeds twenty-one, the dealer's hand is the winning hand of said first game.

Upon completion of the game, the final numerical total of said dealer's first game hand are compared with said player's first game hand; said wagers are distributed and all cards additionally drawn are collected except for card no.1, card no.2 and first card 01.

The second game comprises dealing card no.3 face up and card no.4 face up to a player which comprises the player's second game hand. The dealer then is dealt card no.3 face up and card no.4 face down. This is the dealer's second game hand. Card nos.3 and 4 are dealt sequentially to the player and dealer.

At the location remote from said player and said dealer as described above, a second card 02 is dealt face down;

if the player's second game hand has a numerical total of twenty-one and said dealer's second game hand has a numerical total of twenty-one, the dealer's hand is the winning hand of said second game.

According to the standard rules of Black Jack as set forth above, if the player's second game hand has a numerical total less than twenty-one, the player stands or draws additional cards as the player desires provided the numerical total does not exceed twenty-one, and thereafter said dealer's second game hand has a numerical total of twenty-one, the dealer's hand is the winning hand of said second game.

If the player's second game hand does not exceed twenty-one and does exceed the numerical value of the dealer's second game hand, the player's hand is the winning hand of said second game.

If the player's second game hand has a numerical total less than twenty-one, the player draws additional cards as the player desires and the numerical total exceeds twenty-one, the dealer's hand is the winning hand of said second game.

The final numerical total of said dealer's second game hand is compared with the player's second game hand, the wagers are collected or paid off and all cards additionally drawn in said second game except for card no.3, card no.4 and second card 02 are collected.

The third game commences by dealing card no.5 face up and an additional card face up to the player. This comprises the player's third game hand. Card no.5 is dealt face up and additional card face down to the dealer. This comprises the dealer's third game hand. Card no.5 and the additional card are dealt sequentially to the player and the dealer;

if the player's third game hand has a numerical total of twenty-one and said dealer's third game hand has a numerical total of twenty-one, the dealer's hand is the winning hand of said third game;

if the player's third game hand has a numerical total less than twenty-one, the player stands or draws additional cards as the player desires provided the numerical total does not exceed twenty-one, and thereafter said dealer's third game hand has a numerical total of twenty-one, the dealer's hand is the winning hand of said third game;

if the player's third game hand does not exceed twenty-one and does exceed the numerical value of the dealer's third game hand, the player's hand is the winning hand of said third game;

if the player's third game hand has a numerical total less than twenty-one, the player draws additional cards as the player desires and the numerical total exceeds twenty-one, the dealer's hand is the winning hand of said third game.

The final numerical total of said dealer's third game hand is compared with the player's third game hand. The wagers are collected or paid and all cards additionally drawn in said third game are collected except for card no.5.

After the three games of Black Jack are completed, the player has five cards face up before him on the table. The two cards occupying squares 01 and 02 are face down on the table. The player can opt to gain access to these cards 01 and 02 by paying for the right to view same and to use same in conjunction with the five cards face up before him on the table to make a poker hand.

The winner of the poker hand is the highest hand according to the following schedule: seven of a kind in the same suit; six of a kind in the same suit; five of a kind in the same suit; four of a kind in the same suit; full house composed of three of a kind and two of a kind, all in the same suit; royal flush; straight flush.

BRIEF DESCRIPTION OF THE DRAWINGS

FIG. 1 is a gaming table layout upon which the method of the present invention can be practiced.

DETAILED DESCRIPTION OF THE PREFERRED EMBODIMENTS OF THE INVENTION

The method of the present invention can be practiced on a conventional gaming table using the table layout shown generally at 10 in FIG. 1. The table layout 10 includes a plurality of player betting locations 11 arranged around the outer periphery of table 10. In the preferred embodiment, eight player betting locations are positioned at table 10, although fewer or more (i.e. one and above) can be used.

The dealer, as is customary, stands at dealer location 20. From his location at position 20, the dealer has ready access to a dealing shoe, a chip rack and money drop slot (not shown). In front of the dealer on table 10, there are five squares (21) numbered one (1) through five (5).

In front of each of the players, there is a location (22) having five squares numbered one (1) through five (5). On the righthand side of the squares at 21, there are three spaces allotted for bets on Black Jack. On the lefthand side of the squares at 21, there is one space allotted for bets on Poker.

In the center of table 10 between the dealer location 20 and the player betting location diametrically opposite, there is a location 23 containing two squares numbered "01" and "02."

The game is designed to use multiple standard decks of playing cards and so the dealing shoe should be an eight, ten and twelve deck shoe. The decks contain 52 cards comprising the aces, face cards and numbered cards 2 through 10, for each suit.

To play the game "Fimarolla," the players place their wagers on all three Black Jack games and Poker game before the cards are dealt.

A first card, card no.1, is dealt face up to each player and the dealer. Thereupon, a second card, card no.2, is dealt face up to each player and the dealer. These two cards are referred to as the "first base cards."

A card is dealt face down and placed in the center square marked "01." From the two base cards, (no.1 and no.2) the first game of Black Jack proceeds. The players may request additional cards or stay in an attempt to come close to a total of 21 without going over 21. The player must be familiar with the strategy of which hands to stand pat on and which hands to take additional cards. After the game is finished, the bettors are compensated if successful as against the dealer, and all cards are swept away except for base cards nos.1 and 2.

Card no.3 is then dealt face up to each player and the dealer. Card no.4 is dealt face up to each player, but face down to the dealer. Cards nos.3 and 4 are referred to as the "second base cards." In the square marked "02," a card is dealt face down. From this second set of base cards, the second Black Jack game proceeds. After the second game of Black Jack is completed, the winnings, if any are distributed accordingly, and all cards are swept away except for cards no.1, no.2, no.3 and no.4.

Card no.5 is then dealt face up to each player to initiate the third game of Black Jack. An additional card is dealt to each as the second card for this game. Additional "hit" cards if requested are dealt. After the third game of Black Jack is over, all cards are swept away except for cards nos.1, 2, 3, 4 and 5. Cards in the squares "01" and "02" are also left untouched as well.

Using the five remaining cards in front of each player and the dealer, the players and dealer commence a Poker game.

The dealer's poker hand consists of the dealer's five remaining cards plus the cards in the "01" and "02" squares. Each player's poker hand consists of each player's five remaining cards and, at each player's option, the cards in the "01" and "02" squares, which are still face down. To open the card occupying the "01" square, a player must place a chip in front of card no.5. The dealer then collects the chip from each player who paid to include in his poker hand the card occupying the "01" square. To open the card occupying the "02" square, a player must place a chip in front of card no.5. The dealer then collects the chip from each player who paid to include in his poker hand the card occupying the "02" square. Once all the said chips are collected, the dealer goes around the table comparing his hand with each player's hand. The dealer either collects the player's wager, which was made at the beginning of the game before any cards were dealt, or pays the player for a higher hand. The dealer then moves on to the next player until the process is complete.

After the poker game is over, the dealer examines each player's poker hand to determine if any of the players have won a jackpot. A jackpot is awarded to any player who receives seven-of-a-kind in the same suit. The amount in the jackpot is determined by the casino and is funded by the casino. Seventy five percent of the jackpot is awarded to any player who receives six-of-a-kind in the same suit. Fifty percent of the jackpot is awarded to anyone who receives five-of-a-kind in the same suit. If a player possesses four-of-a-kind in the same suit, the player will receive a predetermined amount for each chip bet. If a player possesses a full house composed of three-of-a-kind and two-of-a-kind, all in the same suit, the player will receive a predetermined amount for each chip bet.

If a player draws a royal flush, the player will receive a predetermined amount for each chip bet. If a player draws a straight flush, the player will receive a predetermined amount for each chip bet. The "predetermined amount" for each of the games noted above will be set by the casino.

As noted above, at the conclusion of each game, the house dealer will declare winners and pay the winners in rotation starting from the left of the player "dealer."

It will be understood that modifications and variations may be effected without departing from the scope of novel concepts of the present invention, but it is understood that this application is to be limited only by the scope of the appended claims.

What we claim and desire to protect by Letters Patent is:

1. A method of playing a game among a dealer and at least one player person, utilizing at least eight standard decks of playing cards, each said deck having four different suits, each suit having cards with a face side displaying a number from two to ten respectively, picture cards and an ace comprising:

each player making a plurality of wagers for a plurality of games to be played before any cards are dealt;

dealing card no.1 face up to each player and the dealer, and card no.2 face up to each player and face down to the dealer, said face up card nos.1 and 2 comprising said player's first game hand and said card no.1 face up and card no.2 face down comprising the dealer's first hand;

at a location remote from said player and said dealer, dealing a first card 01 face down;

if the player's first game hand has a numerical total of twenty-one and said dealer's hand has a numerical total of twenty-one, the dealer's hand is the winning hand of said first game;

if the player's first game hand has a numerical total less than twenty-one, the player stands or draws additional cards as the player desires provided the numerical total does not exceed twenty-one, and thereafter, said dealer's hand has a numerical total of twenty-one, the dealer's hand is the winning hand of said first game;

if the player's first game hand does not exceed twenty-one and does exceed the numerical value of the dealer's hand, the player's hand is the winning hand of said first game;

if the player's first game hand has a numerical total less than twenty-one, the player draws additional cards as the player desires and the numerical total exceeds twenty-one, the dealer's hand is the winning hand of said first game;

comparing the final numerical total of said dealer's first game hand with said player's first game hand, distributing said wagers and collecting all cards additionally drawn except for card no.1, card no.2 and first card 01;

dealing card no.3 face up to each player and the dealer, and card no.4 face up to each player and face down to the dealer, said face up card nos.3 and 4 comprising said player's second game hand, and card no.3 face up and card no.4 face down comprising the dealer's second hand;

at a location remote from said player and said dealer, dealing a second card 02 face down;

if the player's second game hand has a numerical total of twenty-one and said dealer's second game hand has a numerical total of twenty-one, the dealer's hand is the winning hand of said second game;

if the player's second game hand has a numerical total less than twenty-one, the player stands or draws additional cards as the player desires provided the numerical total does not exceed twenty-one, and thereafter, said dealer's second game hand has a numerical total of twenty-one, the dealer's hand is the winning hand of said second game;

if the player's second game hand does not exceed twenty-one and does exceed the numerical value of the dealer's second game hand, the player's hand is the winning hand of said second game;

if the player's second game hand has a numerical total less than twenty-one, the player draws additional cards as the player desires and the numerical total exceeds twenty-one, the dealer's hand is the winning hand of said second game;

comparing the final numerical total of said dealer's second game hand with said player's second game hand, distributing said wagers and collecting all cards additionally drawn in said second game except for card no.3, card no.4 and second card 02;

dealing card no.5 face up to each player and the dealer, and an additional card face up to each player and face down to the dealer, said face up card no.5 face up and the additional card comprising said player's third game hand, and said card no.5 face up and additional card face down comprising the dealer's third hand;

if the player's third game hand has a numerical total of twenty-one and said dealer's third game hand has a numerical total of twenty-one, the dealer's hand is the winning hand of said third game;

if the player's third game hand has a numerical total less than twenty-one, the player stands or draws additional cards as the player desires provided the numerical total does not exceed twenty-one, and thereafter, said dealer's third game hand has a numerical total of twenty-one, the dealer's hand is the winning hand of said third game;

if the player's third game hand does not exceed twenty-one and does exceed the numerical value of the dealer's third game hand, the player's hand is the winning hand of said third game;

if the player's third game hand has a numerical total less than twenty-one, the player draws additional cards as the player desires and the numerical total exceeds twenty-one, the dealer's hand is the winning hand of said third game;

comparing the final numerical total of said dealer's third game hand with said player's third game hand, distributing said wagers and collecting all cards additionally drawn in said third game except for card no.5;

playing a poker-like card game with said dealer's hand consisting of card nos.1–5 held by said dealer plus cards 01 and 02; and said player's hand consisting of cards nos.1–5 held by said player and gaining access to cards 01 or 02 or both by paying a predetermined fee for each; and determining the winner of the poker hand to be the hand consisting of up to seven cards with the highest hand determined according to traditional poker rules.

2. The method as defined in claim 1, wherein the winner of the poker hand is determined according to the following rank: seven of a kind in the same suit; six of a kind in the same suit; five of a kind in the same suit; four of a kind in the same suit; full house composed of three of a kind and two of a kind, all in the same suit; royal flush; straight flush.

3. The method as defined in claim 1, wherein a player who obtains a predetermined hand in the poker game is awarded a predetermined jackpot.

* * * * *